United States Patent [19]

Wiegner et al.

[11] 4,402,431

[45] Sep. 6, 1983

[54] DISPENSER CONTAINER WITH COMPRESSIBLE PUMP

[75] Inventors: Georg Wiegner; Peter Geneschen, both of Viersen, Fed. Rep. of Germany

[73] Assignee: Henkel Kommanditgesellschaft auf Aktien, Düsseldorf-Holthausen, Fed. Rep. of Germany

[21] Appl. No.: 226,148

[22] Filed: Jan. 19, 1981

[30] Foreign Application Priority Data

Sep. 22, 1980 [DE] Fed. Rep. of Germany ..... 3035705

[51] Int. Cl.[3] ..... B67D 5/42; B05B 11/02; B05B 11/04

[52] U.S. Cl. ..... 222/207; 222/260; 222/327; 222/383; 222/563; 53/489

[58] Field of Search ..... 222/207, 209, 212, 383, 222/385, 387, 380, 327, 386, 260, 563; 53/489, 432

[56] References Cited

U.S. PATENT DOCUMENTS

| | | | |
|---|---|---|---|
| 2,649,999 | 8/1953 | Burch | 222/386 X |
| 3,075,675 | 1/1963 | Wormser et al. | 222/327 |
| 3,361,305 | 1/1968 | Spatz | 222/383 X |

FOREIGN PATENT DOCUMENTS

| | | | |
|---|---|---|---|
| 2901717 | 7/1980 | Fed. Rep. of Germany | 222/383 |

*Primary Examiner*—David A. Scherbel
*Attorney, Agent, or Firm*—Hammond & Littell, Weissenberger and Muserlian

[57] ABSTRACT

This invention is directed to a dispenser for viscous fluids. More particularly, this invention is directed to a dispenser container for viscous fluids comprising a container body provided with a resiliently compressible portion including a mouthpiece at one end of said container body; a storage chamber to hold material to be dispensed; a piston member arranged in said container body at the other end contacting the inner wall of the container to define a boundary of the storage chamber, the piston member being movable towards and restrained from movement away from said compressible portion; a top surface to the storage chamber; an elastically compressible pump having an inlet valve in the top surface, and outlet valve in the mouthpiece, and a pump chamber between the valves, and a separate removable cover for said dispenser container having a stopper means adapted to cooperate with the outlet of said mouthpiece to seal said outlet, wherein the inner wall of the container is roughened at the zone of insertion of the piston in such a manner to permit the passage of air but to prohibit the passage of material to be dispensed and the stopper means is arranged in the mouthpiece outlet in such a manner to permit the passage of air but to prohibit the passage of material to be dispensed.

4 Claims, 3 Drawing Figures

FIG. 1
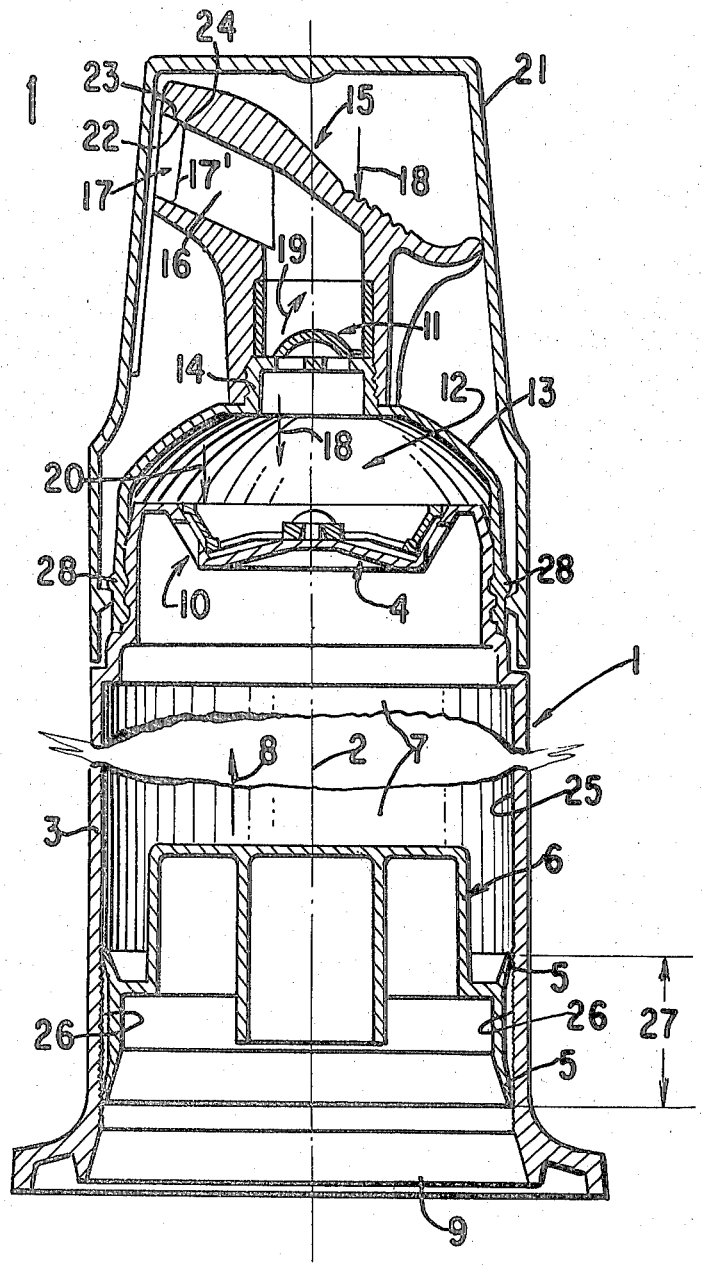
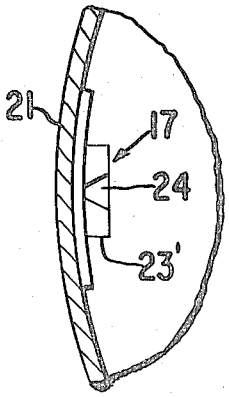
FIG. 2

DISPENSER CONTAINER WITH COMPRESSIBLE PUMP

FIELD OF THE INVENTION

This invention is directed to a dispenser for viscous fluids. More particularly, this invention is directed to a dispenser having an elastically compressible pump means and a piston to effect feed to the pump means.

BACKGROUND OF THE INVENTION

Dispenser containers for viscous fluids are well known. For example, a dispenser for viscous cosmetics such as toothpaste or lotion is described in Kolaczinski et al., U.S. Pat. No. 4,154,371. The Kolaczinski et al. container comprises a piston forming the bottom of the container and being displaceable in the container; a compressible container part, lying in front of the piston; a mouthpiece for withdrawal of the contents, of flexible and elastic material; and a delivery valve opening on excess pressure in the container. The piston is secured by a blocking pawl against any displacement causing enlargement of the interior space of the container.

A similarly useful dispenser is also described in Spatz, U.S. Pat. No. 3,361,305. The piston of the dispenser described, which piston effectively pushes out the container filling, does not require a locking means, for example, catches or ratches, against displacement due to internal displacement or pressure in the container since, when the diaphragm pump is operated, either its inlet valve or its outlet valve is always closed and the material is introduced into the pump chamber by vacuum.

Proper operation of the Spatz dispenser, especially to achieve a sufficiently high filling level of the diaphragm pump, requires freely moving and tightly closing valves. Several flap valves are arranged in the top surface of the container between the storage chamber of the container and the pump chamber, which flap valves are arranged substantially symmetrically to the center of the top surface. While the flap valve openings consist of holes whose surface is slightly inclined to the inside from the edge to the center of the top surface, the respective flaps are a part of a plate arranged in the pump chamber on the top surface. When the diaphragm pump of the dispenser is operated, a flexible, elastic surface is moved downward, perpendicularly to the top surface containing the flap valves in such a way that the product contained in the pump chamber is ejected or dispensed through the delivery valve of the dispenser. When the flexible, elastic surface returns to its normal, unstressed position, the delivery valve is closed because of the resulting vacuum and the inlet flap valves arranged in the top surface open in such a way that new material is drawn into the pump chamber from the interior of the container, that is, from the storage chamber, by the pressure differential, or vacuum, produced in the pump chamber.

Proper operation also requires that as the piston slidingly advances along the cylindrical inner wall of the container, that there be a tight seal, for example, by means of packing washers. Leakage at the points of contact between the piston and inner wall can result in air entering the interior of the container between the piston and the top surface and being delivered instead of viscous product when the diaphragm pump is operated. As in the case of leaks in the inlet and outlet valves, such leaks around the piston have an adverse effect on the filling level of the pump and thus on the dosing accuracy.

When the interior of the container is filled with viscous product to be delivered later by means of the diaphragm pump, the leaving of some air in the container can usually not be avoided. Such air is pushed ahead of the product introduced into the container and thus into the pump chamber. Also, air pushed ahead of the product accumulates in the head of the dispenser when the latter is closed, as is typical, with a lid to prevent drying of the product. Air captured in the interior of the container when the piston is inserted can not escape, since the piston, as mentioned above, must bear tightly on the inner cylinder wall if it is to perform its function properly. Without special measures which interfere with the automatic manufacture and filling of the dispenser, considerable inconveniences may appear, particularly at the start of the operation of the diaphragm pump, because only air is delivered substantially at first.

OBJECTS OF THE INVENTION

It is an object of the invention to provide an improved dispenser for the discharge of viscous liquid.

It is also an object of the invention to provide a dispenser that will discharge viscous liquids in more accurate doses.

It is a further object of the invention to provide a dispensing container comprising a container body provided with a resiliently compressible portion including a mouthpiece at one end of said container body; a storage chamber to hold material to be dispensed; a piston member arranged in said container body at the other end contacting the inner wall of the container to define a boundary of the storage chamber, the piston member being movable towards and restrained from movement away from said compressible portion; a top surface to the storage chamber; and an elastically compressible pump having an inlet valve in the top surface, an outlet valve, and a pump chamber between the valves, the inner wall of the container being roughened at the place of insertion of the piston in such a manner to prohibit the passage of filling but to permit the passage of small amounts of air and the outlet valve opening to an outlet closable by a stopper means.

These and other objects of the invention will become more apparent in the discussion below.

BRIEF DESCRIPTION OF THE DRAWINGS

FIG. 1 represents a longitudinal cross-sectional view of an embodiment of the invention;

FIG. 2 represents a partial cross-sectional view of a detail of the mouthpiece shown in FIG. 1, as viewed from above.

DETAILED DESCRIPTION OF THE INVENTION

Figure 3:
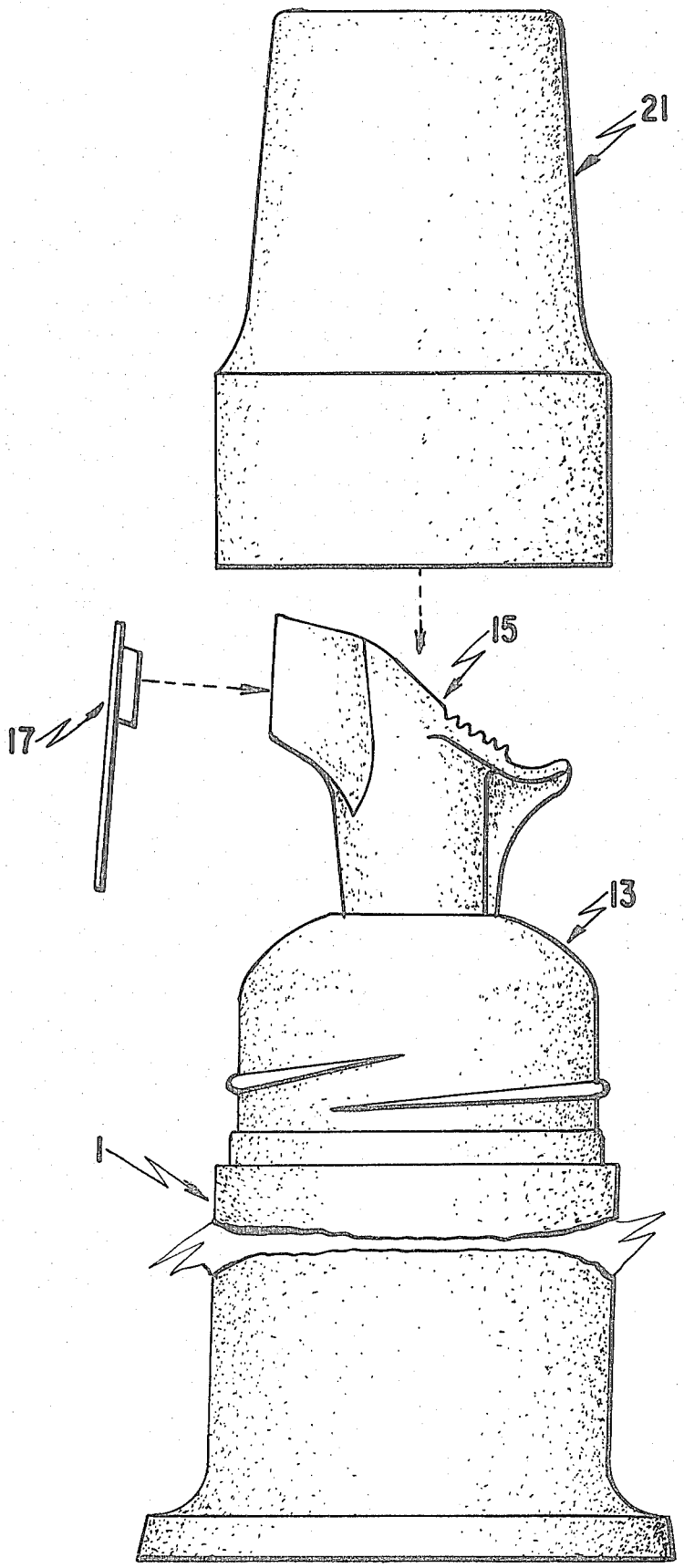
FIG. 3 represents an exploded, perspective view of the embodiment of the invention shown in FIG. 1.

The invention is based on the problem of improving a dispenser of the above-described type so that both the amount of air pushed ahead of the product when the latter is filled in—from the longitudinal end of the container opposite the top surface—and the amount of air captured when the piston is inserted or follows the product, can be eliminated without special efforts, particularly without a separate operating step. The solution according to the invention is a dispenser with a cylindrical container provided with a top surface and with a piston bearing tightly with its circumference on the inner container wall and serving to feed the container filling in the direction of the top surface, as well as with a diaphragm pump means delivering the product from the interior of the container when operated. The dispenser has deliberate air leakage at the longitudinal end of the container opposite the top surface, that is, the bottom end, in the form of a roughening of the cylindrical inner wall of the container in the area where the piston is inserted, and additional such deliberate air leakage at the outlet opening co-operative with the outlet of the diaphragm pump to be closed with a stopper lid, which areas of leakage do not allow the container filling to pass through.

The deliberate air leakage in the area of the stopper lid is achieved preferably in the way that a partial region of the stopper portion of the lid is more inclined relative to the normal of the surface or plane of the outlet opening than the corresponding inner edge of the opening. In particular, a gap can be provided between one edge of the stopper portion of the lid and the corresponding inner edge of the opening, which gap widens from the inside to the outside in the manner of a wedge and is therefore more permeable to air, but tight with regard to the viscous container filling.

According to the invention the roughening that effects the deliberate air leakage at the container wall is only provided at the point where the piston is inserted, that is, at a substantial distance from the top surface of the inner wall of the container. This has the effect that, when the piston is inserted into the interior of the container, air captured between the piston surface and the viscous product, such as, for example, toothpaste or lotion, can escape. The roughening should be so fine or have such a low peak-to-valley distance that air and gases can penetrate between the piston circumference and the inner wall of the container through the "rough gap" but the viscous filling cannot. Because only the filling or piston insert zone of the inner container wall is roughened, which is a relatively great distance from the top surface, air can not penetrate into the space between the piston and top surface and be drawn in during the further operation of the dispenser—where the viscous filling is drained gradually by means of the diaphragm pump and the piston follows by the external air pressure—since the piston quickly arrives, particularly after a few strokes of the diaphragm pump, in the smooth and therefore air-tight range of the inner container wall.

The air pushed ahead of the product during the filling of the respective product in the container from the back opposite the top surface can escape according to the invention past a stopper lid normally closing the head of the dispenser, for example, to prevent drying of the contents of the container. To achieve this, the stopper portion of the lid is made slightly smaller, preferably on one side—because of the otherwise firm fit—than would be necessary for complete air tightness. The gap remaining, which should preferably be designed as a wedge tapering from the inside to the outside, can be easily designed so that it is sufficiently impermeable to air but can be considered tight with regard to the viscous material in the container, and also ensures a firm hold in the opening to be closed.

Other details of the invention will be described and can be appreciated better by making reference to the embodiment of the invention set forth in the drawings. FIG. 1 shows a dispenser 1 in a cross-section parallel to the longitudinal axis. Dispenser 1 consists of a substantially cylindrical container 3, axially symmetrical to longitudinal axis 2, with integral top surface 4. In container 3 is arranged a piston 6 with a circumferential packing washer 5 which can be displaced against inner wall 25 of container 3 in the direction of arrow 8. Piston 6 is inserted into container 3 from filling end 9 opposite top surface 4.

On the head or top portion of container 3 is provided a diaphragm pump consisting of inlet valve 10 connected with top surface 4, outlet valve 11, and an elastically compressible pump chamber 12 positioned between valves 10 and 11 and closed within the exception of the valves. In the embodiment represented a dome 13 consisting of flexible plastic is used as an elastically compressible element of the diaphragm pump. The latter can have at its upper end a neck 14 to receive valve 11.

A nozzle means 15 suitable for accurate delivery of the container filling can be attached on neck 14. Outlet opening 16 of nozzle means 15 is preferably sealed with a stopper lid 17 sealing outlet opening 16 to, for example, prevent drying of the product contained in outlet opening 16. When dome 13 is actuated, that is, pressed down in the direction of arrow 18, valve 11 opens in the direction of arrow 19, and valve 10 closes in the direction of arrow 20. The product contained in pump chamber 12 can be delivered through outlet opening 16 of nozzle means 15. When dome 13 is released, with the subsequent relaxation and expansion valve 11 closes in the opposite direction of arrow 20. The pressure differential, or vacuum, formed in pump chamber 12 during the expansion of dome 13 has the effect that product is sucked in through valve 10 from the interior or storage chamber 7 of the container, so that pump chamber 12 is again filled with the product.

Difficulties can be encountered in the operation of the above-described dispenser in that a certain amount of air is locked-in or captured with the product when the latter is filled into container 3 from filling end 9. When the container is filled, and pump chamber 12 must also be charged with the viscous product, stopper lid 17 would actually have to be removed from nozzle means 15 to allow any air contained in the head of the dispenser before the penetration of the product to escape. However, in mass production and in the automatic filling of dispenser 1, a temporary loosening of stopper lid 17 of outlet opening 16 can not be integrated, without considerable cost, particularly because the dispenser head is typically prefabricated with a protective capping cover 21. Also, stopper lid 17 cannot be eliminated completely without the risk of premature drying or other damage to product which has penetrated to the outlet passage.

The above-mentioned problems can be eliminated if stopper lid 17 is so designed, at least in portion of its edge zone, that it is deliberately air-permeable but is tight relative to the viscous container filling. Preferably a gap 24 is formed between one edge 22 of the stopper portion 17' of lid 17 and the corresponding inner edge 23 of outlet opening 16, which gap extends in the manner of a wedge from the inside to the outside, as shown in FIG. 2, where surface 23' is substantially co-extensive with inner edge 23 shown in FIG. 1. Gap 24 should be so wide that it is air-permeable when the finished dispenser is filled and therefore permits complete filling of storage chamber 7 of container 3 and at least also of pump chamber 12 in such a way that the diaphragm pump already delivers the viscous material contained in the container at the first operation and at the first stroke. It should be noted that when capping cover 21 covers the dispenser head, the cover 21 snaps over projections or fins 28, which arrangement permits the passage of air transmitted through gap 24.

When dispenser 1 is filled with viscous product, air will also be enclosed in storage chamber 7 of container 3, even when piston 6, which is flush with inner container wall 25, is inserted right after the product. This air must therefore be prevented from getting into the area of top surface 4 and valve 10 provided therein, or otherwise the respective filling level of pump chamber 12 and thus the dosing accuracy of the diaphragm pump will be impaired. The solution according to the invention in this regard consists of having a deliberate air leak in the form of a roughening 26 of the cylindrical inner wall 25 of the container, which leak does not allow the viscous container filling to pass through, the leak being provided in a relatively narrow piston insert range 27 opposite top surface 4, which insert range 27 adjoins filling end 9 of container 3.

Roughening 26, which must be produced during manufacture, particularly during the injection-molding of the container, should have such a topology or peak-to-valley distance such that air can escape through the "rough gap" between the circumference of piston 6 and inner container wall 25, but that the product contained in storage chamber 7 cannot escape.

It is important that the inner container wall 25 is roughened according to the invention only in the piston insert zone 27 and is otherwise so smooth that packing washers 5 acting as cylinder rings of piston 6 also form a substantially air-tight seal, because the penetration or intake of air into storage chamber 7 must be prevented during the advance of the piston. Otherwise, some air would eventually be delivered with the diaphragm pump, but no product. In the arrangement according to the invention, no difficulties are encountered in this respect because the deliberate air leakage of the gap between piston and inner cylinder wall is prescribed only in the piston insert zone, and piston 6 can be lifted beyond the rough zone, at least with one packing washer 5, practically after the first pump stroke.

The embodiment of the invention represented by container 3 can have an inside diameter preferably of about 35 mm and a length preferably of about 110 mm. The part of the container including top surface 4 and the respective valve parts, as well as piston 6, can be made of, for example, hardened polypropylene. A similar material can be used for the parts of valve 11, nozzle means 15, and stopper lid 17. The flexible elastic dome 13, however, is preferably made of a thermoplastic polyester elastomer. The deliberate airleaks at filling end 9 and in the outlet of nozzle 15 can be integrated without difficulty into the manufacturing process during the injection-molding or finishing of the dispenser.

In the subsequent operation of the dispenser, the deliberate leaks are practically not noticed and do not represent a source of trouble.

Aspects of the operation of the dispenser described herein are more fully described in commonly assigned, concurrently filed U.S. patent application Ser. No. 226,149 filed Jan. 19, 1981 for "Dispenser Container for Viscous Fluids", incorporated herein by reference. In addition, the operation and structure of outlet valve 11 is more fully described in commonly assigned, currently filed U.S. patent application Ser. No. 226,147 filed Jan. 19, 1981 for "Flap Valve for a Dispenser", incorporated herein by reference.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A dispenser container for viscous fluids comprising a container body provided with a resiliently compressible portion including a mouthpiece at one end of said container body, the mouthpiece having an outwardly directed outlet; a storage chamber to hold material to be dispensed; a piston member arranged in said container body at the other end contacting the inner wall of the container to define a boundary of the storage chamber, the piston member being movable towards and restrained from movement away from said compressible portion; a top surface to the storage chamber; an elastically compressible pump having an inlet valve in the top surface, an outlet valve in the mouthpiece, and a pump chamber between the valves; a separate removable cover for said dispenser container; and a stopper means adapted to cooperate with the outlet of said mouthpiece to seal said outlet, wherein the inner wall of the container is roughened at the zone of insertion of the piston in such a manner to permit the passage of air but to prohibit the passage of material to be dispensed and there is a small, partial gap between the stopper means and the mouthpiece outlet formed between one edge of the stopper means and the corresponding inner edge of the mouthpiece outlet and being tapered in the manner of a wedge from the inside to the outside, said gap being permeable to air but tight with regard to the material to be dispensed.

2. A dispenser container for viscous fluids comprising a container body provided with a resiliently compressible portion including a mouthpiece at one end of said container body, the mouthpiece having an outwardly directed outlet; a storage chamber to hold material to be dispensed; a piston member arranged in said container body at the other end contacting the inner wall of the container to define a boundary of the storage chamber, the piston member being movable towards and restrained from movement away from said compressible portion; a top surface to the storage chamber; an elastically compressible pump having an inlet valve in the top surface, an outlet valve in the mouthpiece, and a pump chamber between the valves; a separate removable cover for said dispenser container; and a stopper means adapted to cooperate with the outlet of said mouthpiece to seal said outlet, wherein the inner wall of the container is roughened at the zone of insertion of the piston in such a manner to permit the passage of air but to prohibit the passage of material to be dispensed, there is a small, partial gap between the stopper means and the mouthpiece outlet, said gap being permeable to air but tight with regard to the material to be dispensed, and the piston member has two sealing washers and at least one of said sealing washers is positioned to be above the roughened gap when the dispenser is filled.

3. A dispenser container for viscous fluids comprising a continer body including a mouthpiece at one end of said container body, the mouthpiece having an outwardly directed outlet; a storage chamber to hold material to be dispensed; a piston member arranged in said container body at the other end contacting the inner wall of the container to define a boundary of the storage chamber, the piston member being movable towards and restrained from movement away from said mouthpiece; a top surface to the storage chamber; pump means to move said piston towards said mouthpiece; and a stopper means adapted to cooperate with the outlet of said mouthpiece to seal said outlet, wherein the inner wall of the container is roughened at the zone of insertion of the piston in such a manner to permit the passage of air but to prohibit the passage of material to be dispensed, there is a small, partial gap between the stopper means and the mouthpiece outlet, said gap being permeable to air but tight with regard to the material to be dispensed, and the piston member has two sealing washers and at least one of said sealing washers is positioned to be above the roughened gap when the dispenser is filled.

4. A dispenser container for viscous fluids comprising a container body provided with a resiliently compressible portion including a mouthpiece at one end of said container body, the mouthpiece having an outwardly directed outlet; a storage chamber to hold material to be dispensed; a piston member arranged in said container body at the other end contacting the inner wall of the container to define a boundary of the storage chamber, the piston member being movable towards and restrained from movement away from said compressible portion; a top surface to the storage chamber; pump means to move said piston towards said mouthpiece; a separate removable cover for said dispenser container; and a stopper means adapted to cooperate with the outlet of said mouthpiece to seal said outlet, wherein there is a small, partial gap between the stopper means and the mouthpiece outlet formed between one edge of the stopper means and the corresponding inner edge of the mouthpiece outlet and being tapered in the manner of a wedge from the inside to the outside, said gap being permeable to air but tight with regard to the material to be dispensed.

* * * * *